United States Patent [19]

Himelreich, Jr.

[11] Patent Number: 4,469,738

[45] Date of Patent: Sep. 4, 1984

[54] ORIENTED NET FURNITURE SUPPORT MATERIAL

[75] Inventor: Louis E. Himelreich, Jr., Wilmington, Del.

[73] Assignee: E. I. Du Pont De Nemours and Company, Wilmington, Del.

[21] Appl. No.: 516,516

[22] Filed: Jul. 26, 1983

Related U.S. Application Data

[63] Continuation-in-part of Ser. No. 460,098, Jan. 21, 1983, abandoned, which is a continuation-in-part of Ser. No. 407,646, Aug. 12, 1982, abandoned.

[51] Int. Cl.[3] ..... A47C 7/32; A47C 23/18; A47C 23/22; A47C 31/00

[52] U.S. Cl. ..... 428/198; 5/230; 264/DIG. 81; 297/452; 297/463; 428/229; 428/231; 428/255; 428/296

[58] Field of Search ..... 428/229, 231, 255, 198, 428/296, 288; 297/452, 463; 5/230; 264/DIG. 81

[56] References Cited

U.S. PATENT DOCUMENTS

| | | | |
|---|---|---|---|
| 2,919,467 | 1/1960 | Mercer . | |
| 3,023,192 | 2/1962 | Shivers, Jr. | 260/75 |
| 3,132,354 | 5/1964 | Doerer . | |
| 3,557,268 | 1/1971 | Beretta et al. | 264/145 |
| 3,651,014 | 3/1972 | Witsiepe . | |
| 3,763,109 | 10/1973 | Witsiepe . | |
| 3,766,146 | 10/1973 | Witsiepe . | |
| 3,992,499 | 11/1976 | Lee | 264/78 |
| 4,136,715 | 1/1979 | McCormack et al. | 138/130 |
| 4,161,500 | 7/1979 | Schleinitz et al. | 264/1 |

FOREIGN PATENT DOCUMENTS

| | | |
|---|---|---|
| 621569 | 6/1961 | Canada . |
| 1458341 | 12/1976 | United Kingdom . |

OTHER PUBLICATIONS

Copending U.S. Pat. appln. Ser. No. 284,236, filed Jul. 17, 1981 by Hansen et al.

"Challenge of Change", a publn. of E. I. du Pont de Nemours & Co., Jan. 1977.

"Elastomeric Oriented Copolyesters," publn. of E. I. du Pont de Nemours & Co., relating to ELOC Materials.

*Primary Examiner*—James C. Cannon

[57] ABSTRACT

Oriented net furniture support materials made from thermoplastic elastomers have been found to possess a unique combination of properties including high strength, low creep and good flexibility. These furniture support materials can be made by extrusion through a pair of concentric die sets rotating transversely to one another or by weaving of monofilament.

23 Claims, No Drawings

ORIENTED NET FURNITURE SUPPORT MATERIAL

CROSS REFERENCE TO RELATED APPLICATION

This is a continuation-in-part of application Ser. No. 460,098, filed Jan. 21, 1983, now abandoned, which is, in turn, a continuation-in-part of application Ser. No. 407,646, filed Aug. 12, 1982, now abandoned.

DESCRIPTION

Technical Field

This invention relates to certain synthetic oriented net materials suitable for use in furniture, for example, in seats, beds, sofas and chairs. The furniture support material of the present invention will be particularly useful in automobile seats (both bottoms and backs) and in seats used in other forms of ground transportation (e.g. buses, trains, etc.) and in aircraft, where a combination of comfort, strength, and especially light weight is important. Typically, the furniture support material of the present invention is suitable for use as a flexible support member in seat bottoms and backs where traditionally, such support members have taken the form of springs, webs, straps or molded units (e.g. thick foam pads), and materials of construction for such seating support members have been steel, burlap, canvas, plastic and elastomeric strapping and synthetic textile materials. Similarly, the furniture support material is suitable for use in beds in lieu of box of wire springs, especially in fold-away and portable beds where compact size and light weight are especially important. Such furniture support materials must satisfy certain physical requirements including high strength, low creep (shape and size retention), high durability, ability to flex under load, and increasingly in today's marketplace, low weight. Increasing demand for improvements in one or more of these criteria lay the groundwork for the present invention.

Background Art

U.S. Pat. No. 2,919,467, granted Jan. 5, 1960 to Mercer, discloses a method and apparatus for making plastic netting having the general physical configuration of one embodiment of the netting used in the furniture support material of the present invention. Mercer lists a wide variety of materials as being within his definition of "plastic", and included within his list is polyesters. Mercer does not disclose the use of the copolyetherester elastomers used in the present invention. In addition, Mercer lists a wide variety of uses for his plastic netting, and included within his list is "armouring upholstery" and "furnishing fabrics". However, Mercer does not disclose that his netting can be used in furniture support material.

U.S. Pat. Nos. 3,651,014; 3,763,109; and 3,766,146, granted Mar. 21, 1972, Oct. 2 and Oct. 16, 1973, respectively, all to Witsiepe disclose certain copolyetherester elastomers which can be used alone or in combination with each other as the material of construction in the net furniture support material of the present invention.

British Pat. No. 1,458,341, published Dec. 15, 1976 to Brown et al, discloses an orientation and heat-setting process for treating copolyetherester elastomers, which process is conveniently and beneficially used to treat the elastomers disclosed by Witsiepe in U.S. Pat. Nos. 3,763,109 and 3,766,146. The Brown process can be used to treat filaments of Witsiepe's copolyetherester elastomers (which can be subsequently woven into a net-like structure) and to treat net made by the teachings of Mercer from the Witsiepe copolyetherester elastomers.

U.S. Pat. No. 4,136,715, granted Jan. 30, 1979 to McCormack et al, discloses composites of different copolyetherester elastomers having melting points differing from each other by at least 20° C. Such composites are used in one embodiment of the furniture support material of the present invention and are conveniently formed as a "sheath/core" monofilament (as shown in FIG. 1 of McCormack et al) where the core copolyetherester elastomer is the higher melting point material.

DISCLOSURE OF THE INVENTION

This invention relates to synthetic oriented net furniture support material made from certain orientable thermoplastic elastomers. The net structure used in the furniture support material of the present invention can be extruded as a unitary net structure as described in detail in U.S. Pat. No. 2,919,467, the subject matter of which is hereby incorporated herein by reference. Alternatively, the net structure used in the furniture support material of the present invention can be prepared by extrusion of a plurality of monofilaments, placing the monofilaments into a net-like configuration, e.g. by weaving and then bonding the monofilaments to each other where ever they intersect. Standard weaving techniques, e.g. as shown in Fiber to Fabric, M. D. Potter, pages 59–73 (1945), can be used to prepare the woven embodiments of the present invention.

The orientable thermoplastic elastomer used in the furniture support material of the present invention can be a copolyetherester elastomer, a polyurethane elastomer, or a polyesteramide elastomer. It can be solid, where the material of construction is the same throughout, or a sheath/core monofilament, where the melting point of the sheath component is substantially lower than the melting point of the core component. In any case, the $M_{20}$ strength (i.e. the tensile strength at 20% elongation, measured according to ASTM D-412) of the oriented thermoplastic elastomer monofilament should be 5,000–45,000 p.s.i. (34.5–310.3 MPa), preferably 15,000–25,000 (103.4–172.4 MPa).

The preferred material of construction of the furniture support material of the present invention is a copolyetherester elastomer, such as disclosed by Witsiepe (U.S. Pat. Nos. 3,651,014; 3,763,109; and 3,766,146) and McCormack (U.S. Pat. No. 4,136,715), which material has been oriented for improved physical properties, such as by the technique disclosed by Brown et al (British Pat. No. 1,458,341).

The copolyetherester polymer which can be used in the instant invention consists essentially of a multiplicity of recurring intralinear long-chain and short-chain ester units connected head-to-tail through ester linkages, said long-chain ester units being represented by the following structure:

$$-\mathrm{OGO}-\overset{\overset{\mathrm{O}}{\|}}{\mathrm{C}}\mathrm{R}\overset{\overset{\mathrm{O}}{\|}}{\mathrm{C}}- \qquad \text{(a)}$$

and said short-chain ester units being represented by the following structure:

$$-ODO-\overset{O}{\overset{\|}{C}}R\overset{O}{\overset{\|}{C}}- \quad (b)$$

wherein:

G is a divalent radical remaining after removal of terminal hydroxyl groups from poly(alkylene oxide) glycols having a carbon-to-oxygen ratio of about 2.0–4.3 and molecular weight between about 400 and 6000;

R is a divalent radical remaining after removal of carboxyl groups from a dicarboxylic acid having a molecular weight less than about 300; and D is a divalent radical remaining after removal of hydroxyl groups from a low molecular weight diol having a molecular weight less than about 250.

The term "long-chain ester units" as applied to units in a polymer chain refers to the reaction product of a long-chain glycol with a dicarboxylic acid. Such "long-chain ester units," which are a repeating unit in the copolyetheresters of this invention, correspond to formula (a) above. The long-chain glycols are polymeric glycols having terminal (or as nearly terminal as possible) hydroxy groups and a molecular weight from about 400–6000. The long-chain glycols used to prepare the copolyetheresters of this invention are poly(alkylene oxide) glycols having a carbon-to-oxygen ratio of about 2.0–4.3.

Representative long-chain glycols are poly(ethylene oxide) glycol, poly(1,2- and 1,3-propylene oxide) glycol, poly(tetramethylene oxide) glycol, random or block copolymers of ethylene oxide and 1,2-propylene oxide, and random or block copolymers of tetrahydrofuran with minor amounts of a second monomer such as 3-methyltetrahydrofuran (used in proportions such that the carbon-to-oxygen mole ratio in the glycol does not exceed about 4.3). Poly(tetramethylene oxide) glycol (PTMEG) is preferred; however, it should be noted that some or all of the long chain ester units derived from PTMEG (or any of the other listed long-chain glycols) and terephthalic acid can be replaced by similar long-chain units derived from a dimer acid (made from an unsaturated fatty acid) and butane diol. A $C_{36}$ dimer acid is commercially available.

The term "short-chain ester units" as applied to units in a polymer chain refers to low molecular weight compounds or polymer chain units having molecular weights less than about 550. They are made by reacting a low molecular weight diol (below about 250) with a dicarboxylic acid to form ester units represented by formula (b) above.

Included among the low molecular weight diols which react to form short-chain ester units are aliphatic, cycloaliphatic, and aromatic dihydroxy compounds. Preferred are diols with 2–15 carbon atoms such as ethylene, propylene, tetramethylene, pentamethylene, 2,2-dimethyltrimethylene, hexamethylene, and decamethylene glycols, dihydroxy cyclohexane, cyclohexane dimethanol, resorcinol, hydroquinone, 1,5-dihydroxy naphthalene, etc. Especially preferred are aliphatic diols containing 2–8 carbon atoms. While unsaturated low molecular weight diols are normally not preferred because they may undergo homopolymerization it is possible to use minor amounts of diols such as 1,4-butene-2-diol in admixture with saturated diols. Included among the bis-phenols which can be used are bis(p-hydroxy)diphenyl, bis(p-hydroxyphenyl) methane, and bis(p-hydroxyphenyl) propane. Equivalent ester-forming derivatives of diols are also useful (e.g., ethylene oxide or ethylene carbonate can be used in place of ethylene glycol). The term "low molecular weight diols" as used herein should be construed to include such equivalent ester-forming derivatives; provided, however that the molecular weight requirement pertains to the diol only and not to its derivatives.

Dicarboxylic acids which are reacted with the foregoing long-chain glycols and low molecular weight diols to produce the copolyesters used in this invention are aliphatic, cycloaliphatic, or aromatic dicarboxylic acids of a low molecular weight, i.e., having a molecular weight of less than about 300. The term "dicarboxylic acids" as used herein, includes equivalents of dicarboxylic acids having two functional carboxyl groups which perform substantially like dicarboxylic acids in reaction with glycols and diols in forming copolyester polymers. These equivalents include esters and ester-forming derivatives, such as acid halides and anhydrides. The molecular weight requirement pertains to the acid and not to its equivalent ester or ester-forming derivative. Thus, an ester of a dicarboxylic acid having a molecular weight greater than 300 or an acid equivalent of a dicarboxylic acid having a molecular weight greater than 300 are included provided the acid has a molecular weight below about 300. The dicarboxylic acids can contain any substituent groups or combinations which do not substantially interfere with the copolyester polymer formation and use of the polymer of this invention.

Aliphatic dicarboxylic acids, as the term is used herein, refers to carboxylic acids having two carboxyl groups each attached to a saturated carbon atom. If the carbon atom to which the carboxyl group is attached is saturated and is in a ring, the acid is cycloaliphatic. Aliphatic or cycloaliphatic acids having conjugated unsaturation often cannot be used because of homopolymerization. However, some unsaturated acids, such as maleic acid, can be used.

Aromatic dicarboxylic acids, as the term is used herein, are dicarboxylic acids having two carboxyl groups attached to a carbon atom in an isolated or fused benzene ring. It is not necessary that both functional carboxyl groups be attached to the same aromatic ring and where more than one ring is present, they can be joined by aliphatic or aromatic divalent radicals or divalent radicals such as —O— or —$SO_2$—.

Representative aliphatic and cycloaliphatic acids which can be used for this invention are sebacic acid, 1,3-cyclohexane dicarboxylic acid, 1,4-cyclohexane dicarboxylic acid, adipic acid, glutaric acid, succinic acid, carbonic acid, oxalic acid, azelaic acid, diethylmalonic acid, allylmalonic acid, 4-cyclohexene-1,2-dicarboxylic acid, 2-ethylsuberic acid, 2,2,3,3-tetramethylsuccinic acid, cyclopentanedicarboxylic acid, decahydro-1,5-naphthalene dicarboxylic acid, 4,4'-bicyclohexyl dicarboxylic acid, decahydro-2,6-naphthalene dicarboxylic acid, 4,4'-methylene bis-(cyclohexane carboxylic acid), 3,4-furan dicarboxylic acid, and 1,1-cyclobutane dicarboxylic acid. Preferred aliphatic acids are cyclohexane-dicarboxylic acids and adipic acid.

Representative aromatic dicarboxylic acids which can be used include terephthalic, phthalic and isophthalic acids, bi-benzoic acid, substituted dicarboxy compounds with two benzene nuclei such as bis(p-carboxyphenyl) methane, p-oxy(p-carboxyphenyl) benzoic acid, ethylene-bis(p-oxybenzoic acid), 1,5-naphthalene dicarboxylic acid, 2,6-naphthalene dicarboxylic acid, 2,7-naphthalene dicarboxylic acid, phenanthrene dicarboxylic acid, anthracene dicarboxylic acid, 4,4'-sulfonyl dibenzoic acid, and $C_1$–$C_{12}$ alkyl and ring substitution derivatives thereof, such as halo, alkoxy, and aryl derivatives. Hydroxyl acids such as p-(β-hydroxyethoxy) benzoic acid can also be used providing an aromatic dicarboxylic acid is also present.

Aromatic dicarboxylic acids are an especially preferred class for preparing the copolyetherester polymers used in this invention. Among the aromatic acids, those with 8–16 carbon atoms are preferred, particularly the phenylene dicarboxylic acids, i.e., phthalic, terephthalic and isophthalic acids and their dimethyl derivatives.

It is preferred that at least about 70% of the short segments are identical and that the identical segments form a homopolymer in the fiber-forming molecular weight range (molecular weight 5000) having a melting point of at least 150° C. and preferably greater than 200° C. Polymers meeting these requirements exhibit a useful level of properties such as tensile strength and tear strength. Polymer melting points are conveniently determined by differential scanning calorimetry.

Other orientable thermoplastic elastomers useful in the furniture support material of the present invention include polyesterurethane elastomers, such as disclosed by Schollenberger (U.S. Pat. No. 2,871,218) and polyetherester amide elastomers, such as disclosed by Foy (U.S. Pat. No. 4,331,786) and Burzin (U.S. Pat. No. 4,207,410).

Thermoplastic polyesterurethane elastomers which can be used in the instant invention are prepared by reacting a polyester with a diphenyl diisocyanate in the presence of a free glycol. The ratio of free glycol to diphenyl diisocyanate is very critical and the recipe employed must be balanced so that there is essentially no free unreacted diisocyanate or glycol remaining after the reaction to form the elastomer of this invention. The amount of glycol employed will depend upon the molecular weight of the polyester as discussed below.

The preferred polyester is an essentially linear hydroxyl terminated polyester having a molecular weight between 600 and 1200 and an acid number less than 10, preferably the polyester has a molecular weight of from about 700 to 1100 and an acid number less than 5. More preferably the polyester has a molecular weight of 800 to 1050 and an acid number less than about 3 in order to obtain a product of optimum physical properties. The polyester is prepared by an esterification reaction of an aliphatic dibasic acid or an anhydride thereof with a glycol. Molar ratios of more than 1 mol of glycol to acid are preferred so as to obtain linear chains containing a preponderance of terminal hydroxyl groups.

The basic polyesters include polyesters prepared from the esterification of such dicarboxylic acids as adipic, succinic, pimelic, suberic, azelaic, sebacic or their anhydrides. Preferred acids are those dicarboxylic acids of the formula HOOC—R—COOH, where R is an alkylene radical containing 2 to 8 carbon atoms. More preferred are those represented by the formula $HOOC(CH_2)_xCOOH$, where x is a number from 2 to 8. Adipic acid is preferred.

The glycols utilized in the preparation of the polyester by reaction with the aliphatic dicarboxylic acid are preferably straight chain glycols containing between 4 and 10 carbon atoms such as butanediol-1,4, hexamethylene-diol-1,6, and octamethylenediol-1,8. In general the glycol is preferably of the formula $HO(CH_2)_xOH$, wherein x is 4 to 8 and the preferred glycol is butanediol-1,4.

A free glycol must also be present in the polyester prior to reaction with the diphenyl diisocyanate. The units formed by reaction of the free glycol with the diisocyanate will constitute the short-chain urethane units. Similarly the units formed by reaction of polyester with diisocyanate constitute the long-chain urethane units. Advantage may be taken of residual free glycol in the polyester if the amount is determined by careful analysis. The ratio of free glycol and diphenyl diisocyanate must be balanced so that the end reaction product is substantially free of excess isocyanate or hydroxyl groups. The glycol preferred for this purpose is butanediol-1,4. Other glycols which may be employed include the glycols listed above.

The specific diisocyanates employed to react with the mixture of polyester and free glycol are also important. A diphenyl diisocyanate such as diphenyl methane diisocyanate, p,p'-diphenyl-diisocyanate, dichlorodiphenyl methane diisocyanate, dimethyl diphenyl methane diisocyanate, bibenzyl diisocyanate, diphenyl ether diisocyanate are preferred. Most preferred are the diphenyl methane diisocyantes and best results are obtained from diphenyl methane-p,p'-diisocyanate.

Thermoplastic polyetherester amide elastomers which can be used in the instant invention are represented by the following formula $$\left[\begin{array}{c} C-A-C-O-B-O \\ \| \qquad\quad \| \\ O \qquad\quad O \end{array}\right]_n$$

wherein A is a linear saturated aliphatic polyamide sequence formed from a lactam or amino acid having a hydrocarbon chain contining 4 to 14 carbon atoms or from an aliphatic $C_6$–$C_{12}$ dicarboxylic acid and a $C_6$–$C_9$ diamine, in the presence of a chain-limiting aliphatic carboxylic diacid having 4 to 20 carbon atoms; and B is a polyoxyalkylene sequence formed from linear or branched aliphatic polyoxyalkylene glycols, mixtures thereof or copolyethers derived therefrom, said polyoxyalkylene glycols having a molecular weight of between 200–6,000. The polyamide sequence A consists of a plurality of short-chain amide units. The polyoxyalkylene sequence B represents a long-chain unit. The polyetherester amide block copolymer is prepared by reacting a dicarboxylic polyamide, the COOH groups of which are located at the chain ends, with a polyoxyalkylene glycol hydroxylated at the chain ends, in the presence of a catalyst constituted by a tetraalkylorthotitanate having the general formula $Ti(OR)_4$, wherein R is a linear branched aliphatic hydrocarbon radical having 1 to 24 carbon atoms.

Approximately equimolar amounts of the dicarboxylic polyamide and the polyoxyalkylene glycol are used, since it is preferred that an equimolar ratio should exist between the carboxylic groups and the hydroxyl groups, so that the polycondensation reaction takes place under optimum conditions for achieving a substantially complete reaction and obtaining the desired product.

The polyamides having dicarboxylic chain ends are preferably linear aliphatic polyamides which are obtained by conventional methods currently used for preparing such polyamides, such methods comprising, e.g.

the polycondensation of a lactam or the polycondensation of an amino-acid or of a diacid and a diamine, these polycondensation reactions being carried out in the presence of an excess amount of an organic diacid the carboxylic groups of which are preferably located at the ends of the hydrocarbon chain; these carboxylic diacids are fixed during the polycondensation reaction so as to form constituents of the macromolecular polyamide chain, and they are attached more particularly to the ends of this chain, which allows an α-ω-dicarboxylic polyamide to be obtained. Furthermore, this diacid acts as a chain limitator. For this reason, an excess amount of α-ω-dicarboxylic diacid is used with respect to the amount necessary for obtaining the dicarboxylic polyamide, and by conveniently selecting the magnitude of this excess amount the length of the macromolecular chain and consequently the average molecular weight of the polyamides may be controlled.

The polyamide can be obtained starting from lactams or amino-acids, the hydrocarbon chain of which comprises from 4 to 14 carbon atoms, such as caprolactam, oenantholactam, dodecalactam, undecanolactam, dodecanolactam, 11-amino-undecanoic acid, or 12-aminododecanoic acid.

The polyamide may also be a product of the condensation of a dicarboxylic acid and diamine, the dicarboxylic acid containing 4 to 14 preferably from about 6 to about 12 carbon atoms in its alkylene chain and a diamine containing 4 to 14 preferably from about 6 to about 9 carbon atoms in its alkylene chain. Examples of such polyamides include nylon 6-6, 6-9, 6-10, 6-12 and 9-6, which are products of the condensation of hexamethylene diamine with adipic acid, azelaic acid, sebacic acid, 1,12-dodecanedioic acid, and of nonamethylene diamine with adipic acid. Preferred are polyamides based on nylon 11 or 12.

The diacids which are used as chain limiters of the polyamide synthesis and which provide for the carboxyl chain ends of the resulting dicarboxylic polyamide preferably are aliphatic carboxylic diacids having 4 to 20 carbon atoms, such as succinic acid, adipic acid, suberic acid, azelaic acid, sebacic acid, undecanedioic acid and dodecanedioic acid.

They are used in excess amounts in the proportion required for obtaining a polyamide having the desired average molecular weight within the range of between 300 and 15000 in accordance with conventional calculations such as currently used in the field of polycondensation reactions.

The polyoxyalkylene glycols having hydroxyl chain ends are linear or branched polyoxyalkylene glycols having an average molecular weight of no more than 6000 and containing 2 to about 4 carbon atoms per oxylalkylene unit such as polyoxyethylene glycol, polyoxypropylene glycol, polyoxytetramethylene glycol or mixtures thereof, or a copolyether derived from a mixture of alkylene glycols containing 2 to about 4 carbon atoms or cyclic derivatives thereof, such as ethylene oxide, propylene oxide or tetrahydrofurane. Polyoxytetramethylene glycol is preferred The average molecular weight of the polyamide sequence in the block copolymer may vary from about 300 to about 15,000, preferably from about 1000 to about 10,000.

The average molecular weight of the polyoxyalkylene glycols forming the polyoxyalkylene sequence suitably is in the range of from about 200 to about 6,000, preferably about 400 to about 3000.

Other thermoplastic polyetherester amides which can be used in the instant invention consist of mixtures of one or more polyamide forming compounds, polytetramethyleneether glycol (PTMEG) and at least one organic dicarboxylic acid, the latter two components being present in equivalent amounts.

The polyamide-forming components are omega-aminocarboxylic acids and/or lactams of at least 10 carbon atoms, especially lauryllactam and/or omega-aminododecanoic acid or omega-aminoundecanoic acid.

The diol is PTMEG having an average molecular weight of between about 400 and 3,000.

Suitable dicarboxylic acids are aliphatic dicarboxylic acids of the general formula $HOOC—(CH_2)_x—COOH$, wherein x can have a value of between and 4 and 11. Examples of the general formula are adipic acid, pimelic acid, suberic acid, azelaic acid, sebacic acid and decanedicarboxylic acid. Furthermore usable are cycloaliphatic and/or aromatic dicarboxylic acids of at least eight carbon atoms, e.g. hexahydroterephthalic acid, terephthalic acid, isophthalic acid, phthalic acid, or naphthalene-dicarboxylic acids.

In the preparation of the polyetherester amides, conventional catalysts are utilized, if desired, in the usual quantities, such as, for example, phosphoric acid, zinc acetate, calcium acetate, triethylamine, or tetraalkyl titanates. Advantageously, phosphoric acid is used as the catalyst in amounts of between 0.05 and 0.5% by weight.

The polyetherester amides can also contain additives which are introduced prior to, during, or after the polycondensation. Examples of such additives are conventional pigments, flattening agents, auxiliary processing agents, fillers, as well as customary thermal and UV stabilizers.

The short-chain ester, urethane and amide units described above will constitute about 50–95% by weight, preferably 60–85% by weight, of the polymer and ergo, the long chain ester of ether units constitute about 5–50% by weight, preferably 15–40% by weight of the polymer. Accordingly, the shore D hardness of the polymer should be 45–85, preferably 55–75 to obtain polymers suited for the production of oriented monofilaments whose $M_{20}$ is in the range of from about 5,000 to about 45,000 p.s.i. (34.5–310.3 MPa), preferably in the range of from about 15,000 to about 25,000 p.s.i. (103.4–172.4 MPa).

If the thermoplastic elastomer filaments are sheath-/core, it is preferred that the short-chain ester, urethane or amide units be at least 50 weight percent of the core elastomer, with a minimum of 60 weight percent short-chain ester, urethane or amide units being more preferred and a range of 65 to 85 weight percent short-chain ester, urethane or amide units being most preferred for the core. The sheath thermoplastic elastomer should have a melting point of at least 20 degrees C. lower than the core elastomer, and accordingly, it will contain either a lower proportion of short-chain ester, urethane or amide units or a mixture of chemically dissimilar short-chain ester, urethane or amide units. In any event, the sheath elastomer will contain at least 20 weight percent short-chain ester, urethane or amide units, preferably at least 30 weight percent short-chain units.

As mentioned above, the thermoplastic elastomer can be formed into a net configuration in a process and apparatus as described by Mercer. In this embodiment, a net is formed by extruding the elastomer through a pair of die sets which are relatively displaced transversely to the direction of extrusion into positions in which the die orifices of one set are in registration with those of the other set during which extrusion of the intersection-forming streams occurs through the composite registered die orifices, and into positions of non-registration of the die orifices of the sets during which extrusion of the mesh strand-forming streams occurs, which are divided with a shearing action out of the said intersection-forming streams. It should be noted that extrusion of relatively low hardness elastomer (i.e., polymer containing relatively low amounts of short chain ester, urethane or amide units), may produce some processing difficulties, such as sticking to the surface of the former. This problem can be alleviated by preblending a small quantity (e.g. 5 weight percent) of polypropylene to increase the lubricity of the elastomer. Conveniently, the sets of dies are arranged in an annulus and the relative displacement is rotary. Netting extruded from this type of die-set will be in a diamond-mesh tubular configuration which is then slit on a bias at a 45° angle to the axis of the tube. This changes the diamond-mesh tubular net into a square-mesh flat configuration suitable for orientation to make it useful as a seating support member. This bias-slitting process is described in detail in U.S. Pat. No. 3,557,268, the subject matter of which is hereby incorporated by reference. Machine-direction orientation of the flat elastomer square-mesh net is accomplished by stretching of this square-mesh sheeting along its longitudinal axis by transporting the sheeting over a series of rolls with the later rolls turning at a rate faster than the earlier rolls. The degree of stretch imparted to the sheeting is determined by the relative speeds of the respective rolls. Allowance must be made for the elastic nature of the thermoplastic elastomer. For example, in a typical embodiment where it is desired to achieve a final stretch of 3X, it will be necessary to operate the second roll at a speed 4X the speed of the first roll. Final stretch ratios of 3X to 4X is preferred. Transverse-direction orientation is then accomplished by advancing the machine-direction stretched netting into a tenter frame stretching apparatus and stretching the netting in the transverse direction to a final stretch ratio of about 3X to 4X.

Alternatively, monofilaments of thermoplastic elastomer, either solid or sheath/core as described in McCormack et al can be formed into a net pattern, either by merely laying such filaments across one another or by interweaving the filaments with one another, and subsequently bonding the filaments to one another at the intersections. Bonding of the filaments at the intersections can be by use of conventional adhesives of textile binders. Commercial suspensions of resin in water can be coated onto the filaments, dried to remove water, and cured at 110° to 150° C. for 30° to 150° C. for 30 to 200 seconds. The curing crosslinks the resin in the binder and adheres the filaments to each other at their intersections. Preferably, bonding of the filaments at the intersections is effected by heating the filaments to their melting point, applying sufficient pressure for the respective filaments to flow together, and cooling. In this embodiment, it is preferred that the monofilament be oriented to a final stretch ratio of 3X to 4X before it is placed in a net configuration. Further it is preferred that the monofilament be of the sheath/core variety where the core is the higher melting component. When bonding is effected by heating to the melting point of the elastomer, orientation is at least partially destroyed; however when the filament is of the sheath/core variety, bonding is effected by heating only up to the melting point of the sheath (the core is always higher melting), then only the orientation of the sheath layer is disturbed. The orientation of the core remains substantially undisturbed, and the increased physical properties achieved by orientation of the core filament remains largely undisturbed.

During heat sealing, the furniture support material of the present invention is heated in air at 140° to 180° C. in a tenter oven for 20 to 60 seconds. This causes the sheath of the coextruded monofilament fill to soften and adhere to the monofilament warp. Upon cooling, the fabric is stable and can be cut, sewn and adhesively sealed or stapled to form a suspension.

The desirable properties characteristic of the furniture support material of the present invention can be achieved with some variety in the spacing of the elastomer filaments. Generally the elastomer filaments should be spaced such that the number of picks per meter is in the range of 16/(a) to 160/(a) where (a) is the cross-sectional area of the filament in $mm^2$.

It should be understood that variations from the configurations described above can be made without deviating from the concepts and principles embodied in the present invention. For example, while it is preferred that the furniture support material of the present invention have a uniform density of fill and of warp, variable density warp and/or fill can be achieved by varying the picks per inch or by varying the diameter of the monofilaments.

The net furniture support material of the present invention has a unique combination of properties not found in commercially available furniture support materials and not found in experimental furniture support materials having the same or similar geometric configuration as the net furniture support material of the present invention but made from materials other than oriented thermoplastic elastomer. In particular, the net furniture support material of the present invention has a combination of high tear resistance and low creep (both dead load static creep and dynamic creep). In addition the support factor and the K-factors, as hereinafter described, of the net furniture support material of the present invention are quite low, thus permitting very light weight furniture support members.

Tear resistance is a measure of the energy required to tear a predetermined length of the netting (or other furniture support material), normalized per unit weight or areal density (weight per unit area). The quantification of this property is achieved by preparing a rectangular sample of the furniture support material 30.6 cm by 10.2 cm. This sample is then slit halfway down the center of the 30.6 cm length. The two sides are mounted in an Instron tensile tester to pull a standard trouser tear similar to ASTM D-470, section 4.6. The sample is pulled to destruction at a rate of 5.1 cm/min. The resultant curve of force v. deflection is integrated to obtain a value for the total energy required to complete the 15.3 cm tear and the energy is divided by the areal density (weight per unit area) of the material to normalize the result. A minimum value of 0.40 joules/meter-gram/-$meter^2$ is considered satisfactory.

Creep, both dead load static creep and dynamic creep, are measures of the ability of the furniture support material to retain its original shape and resilience after being subjected to loading. This property of the furniture support material is generally considered along with the unit weight of the support material. For economy of use and, in particular, for weight reduction considerations in automotive and aircraft applications, it is the objective to keep both creep and unit weight at minimum levels. Generally, creep properties vary directly with the magnitude of the applied forces and inversely with the unit weights of furniture support material. Thus one frequently must choose between very low creep and very low unit weight, or select a material somewhere in the middle, which has neither very low creep nor very low unit weight. The materials of the present invention do offer both low creep and low unit weight. This is best understood by referring to the relationship between creep on the one hand, and force and unit weight, on the other. This relationship can be represented by the following equation:

Creep=C×Force/Unit weight where "C" is a constant for any particular material.

In all of the creep tests conducted on the furniture support materials of this invention, the force was the same so that the numerator of the equation, C×Force, can be represented by K which will hereafter be referred to as the "K-factor". As seen from the above equation, this K-factor is equal to the creep times the unit weight and, again, it is the industry objective to achieve minimum values for the "K-factor" values of the various furniture support materials used in the industry. This objective is achieved with the materials of the present invention.

Dead load static creep is a measure of the ability of the furniture support material to retain its original shape and resiliance after being subjected to a static load for an extended period. The quantification of this property is achieved by preparing a seat bottom having a 0.33 meter by 0.38 meter opening, said seat bottom having been made of 2.5 cm thick grade AB exterior plywood. The support material to be tested was stretched approximately 8% (except for samples G and H which were stretched about 17%) in both directons and stapled in place on all four sides. A 334 Newton weight is placed on a 20.3 cm diameter wooden disc which is in turn placed on the furniture support material and left for 112 days. The deflection of the seat bottom is measured at the beginning and the end of the 112 days, and the percent change in deflection is calculated according to the following formula:

$$\%\text{ change in deflection} = \frac{D_{112} - D_0}{D_0} \times 100$$

where $D_0$ is the deflection at the beginning of the 112 days, and $D_{112}$ is the deflection at the end of the 112 days. A maximum value of 14.0% is considered preferred. When extremely light weight materials are desired, some sacrifice in dead load static creep can frequently be tolerated and values as high as 20.0% are considered satisfactory.

While some commercially available competitive materials may offer dead load static creep values approaching this upper limit, they do so only in materials having a considerably higher unit weight. This distinction is most easily demonstrated using the dead load static creep "K-factor", which as described above, equals the actual static creep times the unit weight. Thus if two materials offer the same creep, but one weighs four times as much, the K-factor of the less desirable fabric will be four times higher. Similarly, if they had the same unit weight, but one had four times less creep, the K-factor of the more desirable fabric would be four times lower. For the purpose of further defining the present invention, a static creep K-factor of less than 6000 is considered satisfactory with less than 3000 especially preferred.

Dynamic creep is a measure of the ability of the furniture support material to retain its original shape and resiliance after being subjected to repeated flexing under load. The quantification of this property is achieved by preparing a seat bottom with a 0.33 meter by 0.38 meter opening, said seat bottom being made out of 2.5 cm thick grade AB exterior plywood. The support material to be tested was stretched approximately 8% (except for sample G and H which were stretched about 17%) in both directions and stapled in place on all four sides. Next a burlap fabric was loosely stapled over the support material, followed by a 2.5 cm thick layer of open cell 0.047 g/cm$^3$ density polyurethane foam, which is in turn covered by a 0.045 g/cm$^2$ upholstery fabric. During the test a 778 Newton weight was placed on a buttock form to stimulate a 778 Newton man, which was in turn, placed on the completed seat bottom. This weighted buttock form was then raised (so that there was no weight on the seat bottom) and lowered (so that the seat bottom was supporting the full weight) repeatedly for 25,000 cycles at a frequency of 1050 cycles/hour.

The dynamic creep (i.e. % change in deflection) is calculated according to the following formula:

$$\%\text{ change in deflection} = \frac{D_{25,000} - D_0}{D_0} \times 100$$

where $D_0$ is the deflection of the uncovered (i.e. no burlap, polyurethane form or upholstery fabric) seat bottom due to a 334 Newton weight using a 20.3 cm diameter wooden disc before the test was started, and $D_{25,000}$ is the deflection of the uncovered seat bottom due to a 334 Newton weight using a 20.3 cm diameter wooden disc after 25,000 cycles. A maximum value of 8.0 is considered preferred. As with static creep, where extremely light weight materials are desired, some sacrifice in dynamic creep can frequently be tolerated and values as high as 22.0% are considered satisfactory.

While some commercially available competitive materials may offer dynamic creep values which approach or better this upper limit, they do so only in materials having a considerably higher unit weight. This distinction is most easily demonstrated using the dynamic creep "K-factor", which as described above, equals the actual dynamic creep times the unit weight. For the purpose of further defining the present invention, a dynamic creep K-factor of less than 5000 is considered satisfactory, with less than 2500 especially preferred.

Flexibility, or deflection, is a measure of the ability of the furniture support material to provide a moderate amount of flex under a moderate load. Too much flex and the seat will be considered to be soft or saggy. Too little flex and the seat will be considered too stiff, hard and uncomfortable. The quantification of this property is achieved by preparing a seat bottom having a 0.33 meter by 0.38 meter opening, said seat bottom being made of 2.5 cm thick grade AB exterior plywood. The support material to be tested was stretched approximately 8% (except for samples G and H which were stretched about 17%) in both directions and stapled in place on all four sides. A 334 Newton weight is placed on a 20.3 cm diameter wooden disc which is, in turn, placed on the furniture support material, the weight and the disc being approximately centrally located on the furniture support material. The deflection of the furniture support material is measured in centimeters. A value of 1.25–7.50 cm is considered satisfactory.

Support factor is a measure of the amount (or mass) of furniture support material necessary to provide a predetermined amount of support. This can be considered a measure of the efficiency of the furniture support material. The more efficient the furniture support material, the lighter the furniture support material needed to do a particular job. The quantification of this property is achieved by preparing a seat bottom with a 0.33 meter by 0.38 meter opening, said seat bottom being made out of 2.5 cm thick grade AB exterior plywood. The support material to be tested was stretched approximately 8% (except for samples G and H which were stretched about 17%) in both directions and stapled on all four sides, the seat bottom with the seat support material is covered as described above in the dynamic creep test and, the force which will give a deflection of 3.8 cm (using the 20.3 cm diameter wooden disc as above) is measured. The weight of the furniture support material necessary to cover the seat bottom (including the material under the staples) is measured and the support factor is calculated according to the following formula:

$$\text{Support Factor} = \frac{445 \times Se}{Fe}$$

where

Se is the actual mass in grams of furniture support material, and

Fe is the actual weight (in Newtons) observed at a deflection of 3.8 cm of the furniture support material.

A maximum value of 55 grams is considered satisfactory.

In the following examples, there are shown specific embodiments of the present invention in direct side-by-side comparison with embodiments of commercially available furniture support materials and embodiments similar in physical configuration to the embodiments of the present invention but made from a material of construction other than thermoplastic elastomers. It will be seen that only the embodiments of the present invention have the requisite combination of properties—high tear resistance and low creep (both static and dynamic). In addition, it will be seen that the embodiments of the present invention have a low support factor and K-factors (high efficiency), particularly as compared to several of the commercially available furniture support materials.

All parts and percentages are by weight and all temperatures are in degrees Celsius, unless otherwise specified. Measurements not originally in SI units have been so converted and rounded where appropriate.

EXAMPLE 1

Preparation of High Hardness Copolyetherester Extruded Netting

Netting was made in a two-step process, extrusion of an unoriented netting followed by orientation. Copolyetherester (prepared substantially as in Example 1-B of U.S. Pat. No. 3,763,109 except that the amount of dimethyl terephthalate was increased from 40.5 parts to 55.4 parts. The resulting copolyester contained 81.6% butylene terephthalate short chain ester units and 18.4% long chain ester units derived from PTMEG-975 (polytetramethylene ether glycol having an average molecular weight of 975) and terephthalic acid was extruded through a double rotating slotted die as described in U.S. Pat. No. 2,919,467 at a barrel and die temperature of 232° C. and at a rate of 82 kg/hr onto a horizontal circular former. The counter rotation die speed was adjusted to form a netting with a diamond mesh which was subsequently slit on a 45° diagonal to the axis of the circular former. This resulted in a webbing 34–40 cm wide with longitudinal and transverse strands at right angles on a center line spacing of 0.76–1.3 cm. The longitudinal strands were next oriented in a 8 roll Marshall and Williams machine direction stretcher using a 0.25 cm gap, and a preheat roll temperature of 110° C. The machine orientation ratio (i.e. the difference in speed between fast and slow rolls) was 4.0X. This resulted in a final longitudinal product orientation of 3.0X. The transverse strands were next oriented on a Marshall and Williams tenter frame oven. In this oven the webbing was heated in the preheat stage to 175° C. and then stretched at 180° C. to a machine orientation ratio of 4.0X. This resulted in a final product orientation ratio of 3.0X in the transverse direction. The resulting net had a strand count of approximately 0.33 strands per centimeter and an average strand cross-section of about 0.13 cm by 0.09 cm. This netting will be identified hereinafter as Sample A.

EXAMPLE 2

Preparation of Medium Hardness Copolyetherester Extruded Netting

Netting was made from medium hardness copolyetherester substantially as described in Example 1, above, except as follows:

(a) The copolyetherester was prepared substantially as described in Example 1 of U.S. Pat. No. 3,766,146 except that the amount of dimethyl terephthalate was increased from 600 to 654 g. This copolyester contained 60.0% butylene terephthalate units and 40.0% long chain units derived from PTMEG-975 and terephthalic acid.

(b) Polypropylene (5 weight percent) was preblended with the copolyetherester elastomer to improve the processing properties of the polymer.

(c) The barrel and die temperature was 221° C.

(d) The preheat temperature in the tenter frame oven was 170° C. and the oven temperature was 180° C. The resulting net had a strand count and strand cross-section substantially the same as the net produced in Example 1 above. This netting will be identified hereinafter as Sample B.

EXAMPLE 3

Preparation of Netting From Woven Sheath/Core Monofilaments of Copolyetherester Elastomer Netting was made in a three-step process:

(a) Extrusion and orientation of sheath/core monofilaments.

(b) Weaving of the monofilaments into a fabric.

(c) Heat bonding the woven monofilament fabric in a tenter frame oven.

Copolyetherester elastomer monofilaments were prepared substantially as described in U.S. Pat. Nos. 3,992,499 and 4,161,500. The copolyetherester elastomer in the sheath is as described in Example 1 in U.S. Pat. No. 3,651,014. This copolyester contained 37.6% butylene terephthalate units, 10.9% butylene isophthalate units and 51.5% long chain units derived from PTMEG-1000 and terephthalic and isophthalic acids. The copolyetherester elastomer in the core is as described in Example 1 above. The extrusion conditions were as follows:

| Property | Sheath | Core |
|---|---|---|
| Extruder | 28 mm W & P | 83 mm W & P |
| Extrusion Rate | 100 g/min | 230 g/min |
| Extruder Temperature | 220° C. | 250° C. |
| Die used | 0.25 cm diameter | L/D - 5.0 |

After neck down the solidified unoriented filament diameter was 0.10 cm. This filament was then fed into an 180 cm quench tank with 23° C. water, and was then fed to a 14-roll draw stretcher. The stretching operation consisted of feeding the unoriented filament through a 7-roll section of slow rolls followed by a tank with 70° C. water, and finally feeding the filament through a 7-roll section of fast rolls. The use of the 7 rolls in each section was needed to ensure no slippage of the filament during orientation. The draw ratio of speeds between the fast and slow rolls sections was 4.3X which resulted in a product orientation ratio of 3.2X. The resultant cross-section diameter of the monofilament was 0.05 cm. The weaving of this bi-component filament into a fabric was done in a loom with a warp and fill strand count of 4 strands per centimeter.

The bonding of this woven fabric was accomplished by passing it through a tenter-frame oven at a temperature of 170° C., with a residence time of 30 seconds. During the bonding step it was important to hold the sides of the woven fabric tight so that the bonded fabric would have acceptable creep properties. This netting will be identified hereinafter as Sample C.

EXAMPLE 4

Preparation of Netting From Woven Dissimilar Copolyetherester Elastomers Monofilaments Netting was prepared substantially as described in Example 3 above with the following exceptions:

a. The warp filament comprised a 30% sheath, 70% core monofilament where the sheath was a copolyetherester elastomer as described in Example in U.S. Pat. No. 3,651,014 and the core was a copolyetherester elastomer as described in Example 1 above.

b. The fill monofilament comprised was a 30% sheath, 70% core monofilament where the sheath was the same as used in the warp filament and the core was a copolyetherester elastomer as described in Example 1 of U.S. Pat. No. 3,766,146. The core of the fill filament was extruded at an extruder temperature of 235° C.

c. The loom was set for a strand count of 3.0 strands per centimeter.

This netting will be identified hereinafter as Sample D.

In the following Tables samples E through I represent commercially available materials defined as follows:

Sample E was a "Vexar" plastic netting, available from Amoco Fabrics, Co., Atlanta, Ga. having the following specifications:

Composition—"ProFax" Polypropylene Type 6523
Strand count—0.6 strands per centimeter
Strand cross-section—0.07 cm by 0.03 cm
Orientation ratio—2.9X Sample F was a "Vexar" plastic netting available from Amoco Fabrics, Co., of Atlanta, Ga. having the following specifications:

Composition—"Alathon" high density polyethylene resin type 5294
Strand count—0.6 strand per centimeter
Strand cross-section—0.04 cm by 0.08 cm
Orientation ratio—2.9X Sample G was a woven natural rubber netting type 1480 ORTHA-WEB manufactured by Mateba Webbing of Canada, Dunnsville, Ontario, Canada. The construction of this product consisted of double wrapped natural rubber strands in the warp direction and textured yarn in the fill direction. Dimensions of the warp and fill components were estimated to be:

Strand count warp—6 strands per centimeter
Strand count fill—3 strands per centimeter
Strand cross-section-warp—0.02 cm diameter
Strand cross-section-fill—0.02 cm×0.01 cm Sample H was J. P. Stevens "Flexor" Type K-1692-S available from United Elastic Division, J. P. Stevens and Company, Inc., Woolwine, Va. This product was a knit fabric made on a Raschel machine with a stable stitch and had the following properties:

Composition—warp 19% Spandex, fill 81% nylon
Strand count—warp 6 strands per cm, fill 18 strands per centimeter
Strand diameter—warp 0.03 cm, fill 0.006 cm
Sample H was tested in double thickness.

Sample I was a J. P. Stevens "Flexor" Type K-1949-S which was similar to Sample H above, but had the following physical properties:

Composition warp—30% Spandex, fill 70% nylon
Strand count—warp 6 strands per cm, fill 16 strands per centimeter
Strand diameter warp—0.04 cm, fill 0.006 cm

TABLE I

COMPARISON OF VARIOUS MATERIALS FOR USE AS FURNITURE SUPPORT

| Sample | Tear Resistance J/m - g/m² | Dead Load Static Creep % Change | Static Creep K-Factor % Change - g/m² |
|---|---|---|---|
| A | 0.50 | 11.3 | 1860 |
| B | 0.62 | 13.1 | 2400 |
| C | 1.14 | 4.8 | 590 |
| D | 1.02 | 0.0 | 1250 |
| E | .24 | 19.7 | 3900 |
| F | .34 | 24.2 | 2090 |
| G | .19 | 10.9 | 34,900 |
| H | 1.00 | 16.4 | 64,600 |
| I | 1.00 | 10.9 | 9960 |
| Satisfactory range | ≧0.40 | <20.0 | <6000 |

| Sample | Dynamic Creep % Change | Dynamic Creep K-Factor % Change - g/m² |
|---|---|---|
| A | 7.8 | 1290 |
| B | 7.0 | 1280 |
| C | 0.3 | 37 |
| D | 6.9 | 362 |
| E | * | * |
| F | * | * |
| G | 10.2 | 1,530 |

TABLE I-continued

COMPARISON OF VARIOUS MATERIALS FOR USE AS FURNITURE SUPPORT

| | | |
|---|---|---|
| H | 3.7 | 6570 |
| I | 23.9 | 10,870 |
| Satisfactory range | <22.0 | <5000 |

*Sample tore during test

TABLE II

ADDITIONAL PROPERTIES OF VARIOUS FURNITURE SUPPORT MATERIALS

| Sample | Support Factor (g) | Deflection (cm) |
|---|---|---|
| A | 26.5 | 2.95 |
| B | 52.7 | 3.65 |
| C | 25.6 | 2.20 |
| D | 26.3 | 3.85 |
| E | 41.2 | 5.80 |
| F | 26.0 | 4.50 |
| G | 308 | 4.85 |
| H | 313 | 2.65 |
| I | 55.6 | 2.45 |
| Satisfactory range | <55 | 1.25–7.50 |

EXAMPLE 2

Preparation of Woven Netting with Various Sheath/Core Elastomer Monofilament Fill & Warp Three fabric samples were made using a monofilament fill and warp with the monofilaments having sheaths of copolyetherester elastomer as described in Example 1 in U.S. Pat. No. 3,651,014. This copolyester contains 37.6% butylene terephthalate units, 10.9% butylene isophthalate units and 51.5% long chain units derived from PTMEG-1000 and terephthalic and isophthalic acids. The core of the monofilament fill was a thermoplastic elastomer as follows:

TABLE IV

| Sample | Core Composition |
|---|---|
| J | "Huls" E62L - a polyetherester amide |
| K | "Pebax" 6312 - a polyether block amide of nylon 11 and PTMEG |
| L | "Estane" 58130 - a polyurethane with a polyester and polyether base. |

The monofilaments were coextruded and oriented to 4X. The sheath/core ratio in each of the monofilaments was 20/80 and the caliper of each of the monofilaments was 20 mils (0.51 mm). The samples were plain woven and heat sealed in a tenterframe with a residence time of 30 seconds and an air temperature of 166° C. The samples contained 17, 13 and 16 picks/inch (670, 512 and 630 picks/meter) of the monofilament fill, respectively for each of samples J, K and L and 15, 16 and 16 strands/inch (590, 630 and 630 strands/meter) of the polyester yarn warp in each of Samples J, K and L, respectively.

Each of Samples J–L was tested as described above in Example 1 with the following results:

TABLE V

COMPARISON OF VARIOUS MATERIALS FOR USE AS FURNITURE SUPPORT

| | Tear Resistance | Dead Load Static Creep | Static Creep K-Factor |
|---|---|---|---|

TABLE V-continued

COMPARISON OF VARIOUS MATERIALS FOR USE AS FURNITURE SUPPORT

| Sample | J/m - g/m$^2$ | % Change | % Change - g/m$^2$ |
|---|---|---|---|
| J | 1.03 | 12.0 | 4920 |
| K | 1.18 | 9.9 | 4645 |
| L* | 0.61 | 26.4 | 21,600 |

| Sample | Dynamic Creep % Change | Dynamic Creep K-Factor % Change - g/m$^2$ |
|---|---|---|
| J | 9.4 | 3850 |
| K | 4.6 | 2160 |
| L* | 7.4 | 5890 |

TABLE VI

Additional Properties of Various Furniture Support Materials

| Sample | Support Factor (g) | Deflection (g) |
|---|---|---|
| J | 44.5 | 2.4 |
| K | 50.3 | 2.2 |
| L* | 138 | 3.1 |

*Heat sealing procedure in tenterframe was not followed properly, therefore performance data is anomolous.

INDUSTRIAL APPLICABILITY

The oriented thermoplastic elastomer net furniture support material of the present invention is useful in the manufacture of seat backs and bottoms intended for use in automobiles, aircraft and also in conventional household and industrial furniture. The unique combination of the properties possessed by the furniture support material of the present invention, i.e., high tear resistance, good flexibility, low creep and low support factor render these materials particularly well suited for use in applications where high performance and low weight are especially desirable, such as in automotive and aircraft seating.

BEST MODE

Although the best mode of the present invention, that is the single most preferred embodiment of the present invention, will depend upon the particular desired end use and the specific requisite combination of properties needed for that use; generally, the most preferred embodiment of the present invention is that described in detail above as Sample C.

I claim:

1. A furniture support material in a net configuration comprising crossed strands of oriented thermoplastic elastomer selected from the group consisting of copolyetheresters, polyurethanes and polyesteramides, which strands are bonded to each other at the points at which they cross, which furniture material has a tear resistance value of at least 0.40 joules/meter-gram/meter$^2$, has a dead load static creep K-factor value of less than 6000 percent change in deflection-grams/meter$^2$, has a deflection value of 1.25–7.50 cm, and has a dynamic creep K-factor value of less than 5000 percent change in deflection-grams/meter$^2$.

2. The furniture support material of claim 1 wherein the strands are bonded to each other by their own substance.

3. The furniture support material of claim 1 wherein all of the crossing strands are of the same thermoplastic elastomer.

4. The furniture support material of claim 1 wherein the strands are of a sheath/core configuration wherein the sheath is a thermoplastic elastomer whose melting point is substantially lower than the melting point of the thermoplastic elastomer in the core.

5. The furniture support material of claim 1 which has been made by extrusion of thermoplastic elastomer through a pair of die sets which are relatively displaced transversely to the direction of extrusion into positions where the die orifices in one set are successively in registration and in non-registration with those of the other set.

6. The furniture support material of claim 1 which has been made by extrusion of monofilaments of thermoplastic elastomer, orientation of the monofilaments, arrangement of the monofilaments in a crossing configuration, and bonding the filaments to each other at the points at which they cross.

7. The furniture support material of claim 1 wherein the thermoplastic elastomer is a copolyetherester and contains at least 50 weight percent short chain ester units.

8. The furniture support material of claim 7 wherein the copolyether elastomer contains about 81.6 weight percent butylene terephthalate short chain ester units and about 18.4 weight percent long chain ester units derived from PTMEG and terephthalic acid.

9. The furniture support material of claim 7 wherein the copolyetherester elastomer contains about 60 weight percent butylene terephthalate short chain ester units and about 40 weight percent long chain ester units derived from PTMEG and terephthalic acid.

10. The furniture support material of claim 7 wherein the copolyetherester elastomer is a sheath/core monofilament wherein the core copolyetherester elastomer contains at least 50 weight percent short chain ester units and the sheath copolyetherester elastomer has a melting point at least 20° C. lower than the melting point of the core copolyetherester elastomer.

11. The furniture support material of claim 1 wherein the product orientation ratio is at least 3.0X.

12. The furniture support material of claim 1 wherein the dead load states creep K-factor value is less than 3000 percent change in deflection-grams/meter$^2$ and the dynamic creep K-factor is less than 2500 percent change in deflection-grams/meter$^2$.

13. The furniture support material of claim 1 wherein the dead load static creep is less than 20.0 percent change in deflection and the dynamic creep is less than 22.0 percent change in deflection.

14. The furniture support material of claim 11 where the dead load static creep is less than 14.0 percent change in deflection and the dynamic creep is less than 8.0 percent change in deflection.

15. The furniture support material of claim 1 wherein the thermoplastic elastomer has an $M_{20}$ strength of 34–310 MPa.

16. The furniture support material of claim 1 wherein the thermoplastic elastomer has an $M_{20}$ strength of 103–172 MPa.

17. The furniture support material of claim 1 wherein the thermoplastic elastomer is polyesterurethane.

18. The furniture support material of claim 1 wherein the elastomer strands are spaced such that the number of picks/meter is in the range of 16/(a) to 160/(a) where (a) is the strand cross-sectional area in mm$^2$.

19. The furniture support material of claim 1 wherein:

(a) the elastomer is a copolyetherester having an $M_{20}$ strength of 103–172 MPa, (b) the elastomer strand is a sheath/core monofilament wherein the sheath contains at least 25 weight percent short-chain ester units, the core contains at least 50 weight percent short-chain ester units, and the sheath elastomer has a melting point at least 20° C. lower than the melting point of the core elastomer, and (c) the elastomer strands are bonded at the points at which they cross by partial melting of the sheath elastomer.

20. A seat bottom made from the furniture support material of claim 1.

21. A seat back made from he furniture support material of claim 1.

22. A bedding support system made from the furniture support material of claim 1.

23. The furniture support material of claim 1 wherein the thermoplastic elastomer is polyetheresteramide.

* * * * *